United States Patent [19]

Atsumi et al.

[11] Patent Number: 4,556,768

[45] Date of Patent: Dec. 3, 1985

[54] LIMIT SWITCH ASSEMBLY

[75] Inventors: Haruo Atsumi, Otsu; Norio Iwakiri, Kyoto; Yasuhiro Kiyono, Nagaokakyo; Tomohiko Hayakawa, Kyoto, all of Japan

[73] Assignee: Omron Tateisi Electronics Co., Kyoto, Japan

[21] Appl. No.: 570,103

[22] Filed: Jan. 12, 1984

[30] Foreign Application Priority Data

Jan. 12, 1983 [JP] Japan ..... 58-3158[U]
Jan. 12, 1983 [JP] Japan ..... 58-3159[U]
Jan. 14, 1983 [JP] Japan ..... 58-4006[U]

[51] Int. Cl.[4] ..... H01H 13/06
[52] U.S. Cl. ..... 200/302.2; 200/47
[58] Field of Search ..... 200/302.2, 302.1, 301, 200/47

[56] References Cited

U.S. PATENT DOCUMENTS 3,085,140 4/1963 Roe ..... 200/302.2
3,649,785 3/1972 Dietrich ..... 200/47
3,931,484 1/1976 Chace et al. ..... 200/47
3,987,266 10/1976 Betz ..... 200/302.2
4,342,894 8/1982 Scott et al. ..... 200/302.1

*Primary Examiner*—Stephen Marcus
*Assistant Examiner*—Renee S. Kidorf
*Attorney, Agent, or Firm*—Wegner & Bretschneider

[57] ABSTRACT

A limit switch assembly which comprises a head having an actuator, a switch having a push button protruding outwards from a first area thereof and movable between projected and depressed positions, and also having at least two terminal members protruding outwards from a second area thereof for the electrical connection with external wiring elements, a rubber hood configured to substantially tightly receive the switch therein except for the second area of the switch, and having a circumferential flange formed integrally therewith so as to extend outwards therefrom in a plane generally parallel to the first area of the switch, and a switch box having an opening defined therein at a location confronting the head, and accommodating therein the switch together with the rubber hood. The circumferential flange is, when the switch is so accommodated in the switch box, positioned exteriorly of the switch box and surrounding the opening in the switch box. The head and the switch box are connected together by means of fastening members with the actuator aligned with the push button and, at that time, the circumferential flange area, tightly clamped therebetween.

3 Claims, 9 Drawing Figures

LIMIT SWITCH ASSEMBLY

BACKGROUND OF THE INVENTION

The present invention generally relates to a limit switch assembly and, more particularly, to a limit switch assembly of a type comprising a switch box having a built-in switch, and a head mounted on the switch box and having an actuator for actuating the switch.

Hitherto, numerous types of limit switch assemblies have been developed and placed in the market, some of them employing the actuator in the form of a plunger and some of them employing the actuator in the form of a lever or a combined lever and arm. In all of these prior art assemblies, not only are the head and the switch box connected together with an O-ring interposed therebetween, but the built-in switch is secured in position within the switch box by the use of set screws. Accordingly, it has been found that, even though the O-ring is interposed between the head and the switch box, the O-ring is not effective to avoid any possible intrusion of an undesirable fluid medium such as, for example, oil by the capillary action, and therefore, the built-in switch tends to fail to operate properly when wetted in contact with the fluid medium. In addition, according to the prior art, since the area of the switch from which a push button projects outward is exposed to the outside of the switch box before the head is mounted on the switch box with the actuator aligned with the push button, foreign matter such as dusts and oily substances tend to adhere to the push button which may ultimately result in the malfunctioning of the switch assembly as a whole.

The intrusion of oil into the built-in switch by the capillary action may also take place through the set screws used to secure the switch in position within the switch box, thereby posing a problem similar to that described above. Furthermore, where the switch is secured in position within the switch box by the use of the set screws, impacts and/or vibrations applied exteriorly to the switch box tend to be transmitted to the built-in switch, and, in the worst it may happen, not only does the built-in switch fail to operate properly, but also external wiring elements connected to respective terminal members of the built-in switch may separate from the terminal members.

In view of the foregoing, it can be contemplated to use a rubber hood in a manner as shown in FIG. 9 of the accompanying drawings. Referring to FIG. 9, the rubber hood, generally identified by 34, is configured to substantially tightly receive therein the switch 33 contacting all of the surfaces of said switch including the surface thereof from which the push button protrudes outwards, but excluding the surface thereof from which terminal members protrude outwards. The switch 33 so covered by the rubber hood 34 is secured to a wall of the switch box 20 by means of screws 60 extending through respective mounting holes 33*c* defined in the switch 33 so as to extend completely through the thickness thereof.

In the contemplated arrangement shown in FIG. 9, both the impact resistance and the dust proofness of the switch assembly may be improved. However, a worker engaged in the fabrication of the switch assembly will be forced to locate the mounting holes 33*c* exteriorly of the rubber hood 34 immediately before the screws 61 are inserted therethrough to secure the switch to the wall of the switch box 20. Even if the switch will have been successfully secured to the switch box 20, portions of the rubber hood adjacent the screws extending through the respective mounting holes may be inwardly compressed, as shown, as the screws are fastened, and accordingly, in the assembled condition, the switch 33 may happen to be secured in a manner tilted relative to the wall of the switch box 20. Once this happens, the operating position of the actuator for actuating the push button of the switch may deviate from a predetermined or required position to such an extent as to fail to properly engage an external driving element.

SUMMARY OF THE INVENTION

Accordingly, the present invention has been developed with a view to substantially eliminating the above described disadvantages and inconveniences inherent in the prior art switch assemblies and has for its essential object to provide an improved switch assembly which has a high resistance to impacts and also a high dust proofness and which is reliable in operation.

Another object of the present invention is to provide an improved switch assembly of the type referred to above, wherein means is provided to minimize change in pressure which would occur inside the head as a result of the movement of the actuator, thereby to facilitate a smooth movement thereof with the minimized driving force.

A further object of the present invention is to provide an improved switch assembly of the type referred to above, which can be easily fabricated with no need to locate the mounting holes such as required in the prior art.

BRIEF DESCRIPTION OF THE DRAWINGS

These and other objects and features of the present invention will become apparent from the following detailed description of the preferred embodiment thereof taken in conjunction with reference to the accompanying drawings, in which.

DETAILED DESCRIPTION OF THE EMBODIMENT

Figure 1:
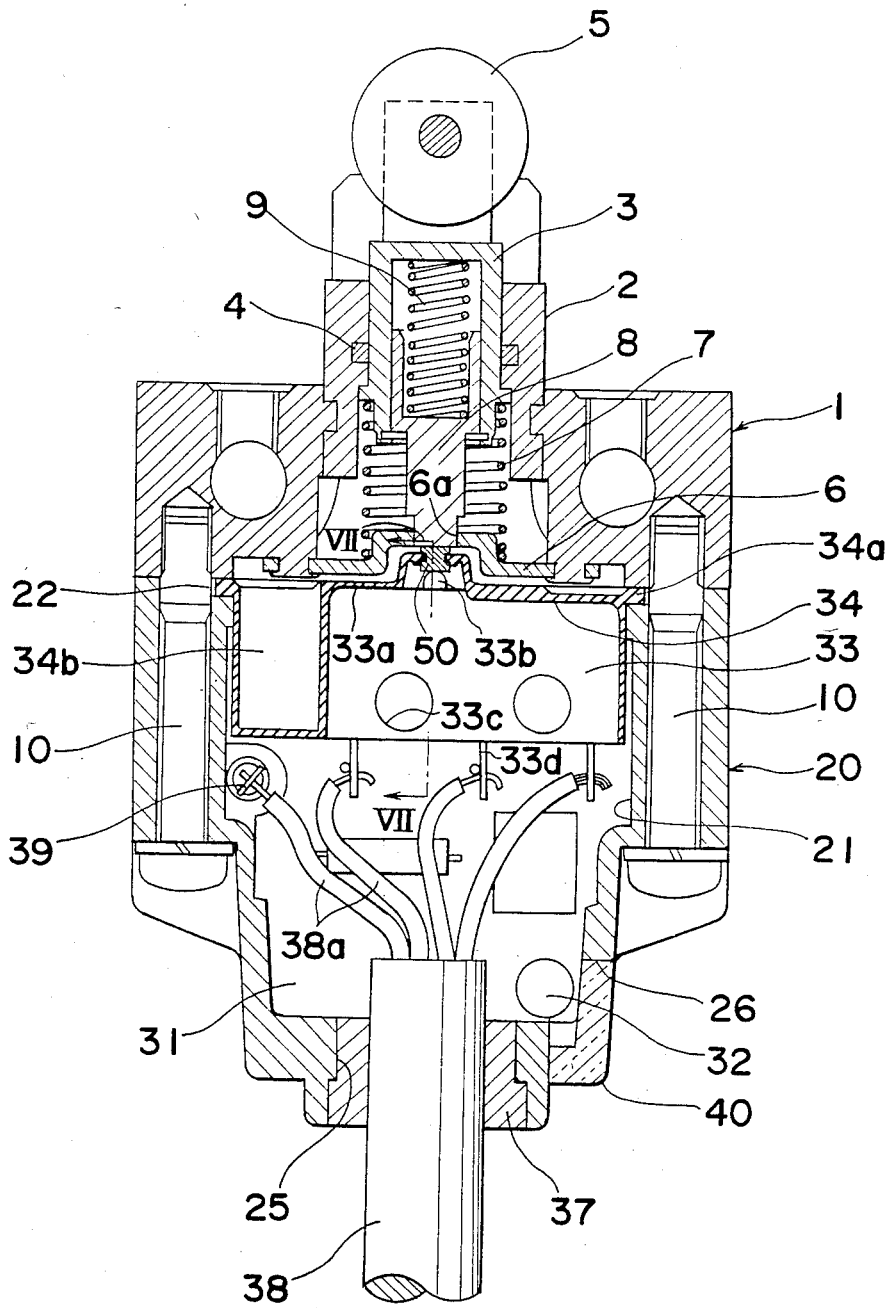
FIG. 1 is a longitudinal sectional view of a limit switch assembly.

Before the description of the present invention proceeds, it is to be noted that like parts are designated by like reference numerals throughout the accompanying drawings.

Figure 2:
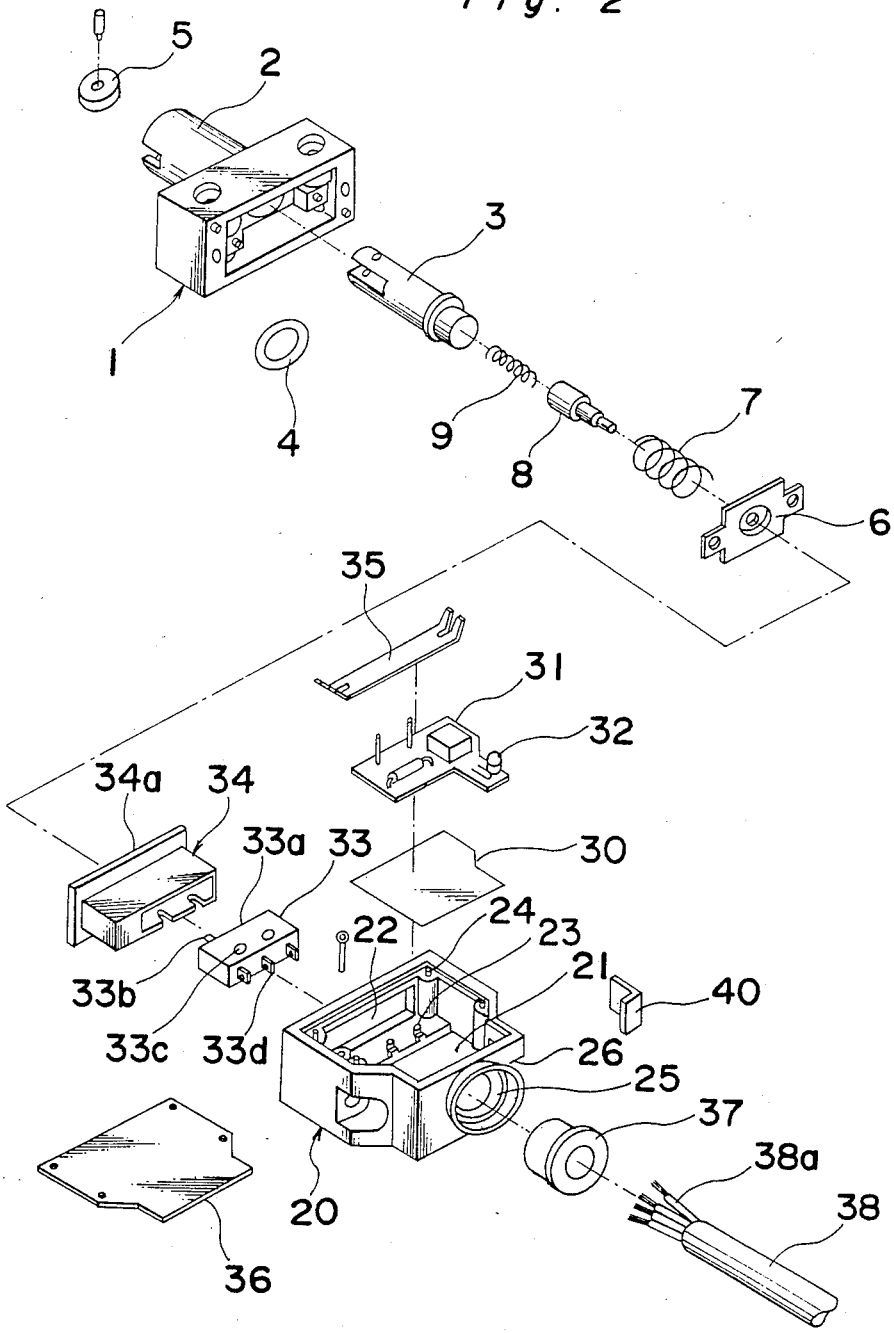
FIG. 2 is an exploded view of the limit switch assembly shown in FIG. 1.
Figure 3:
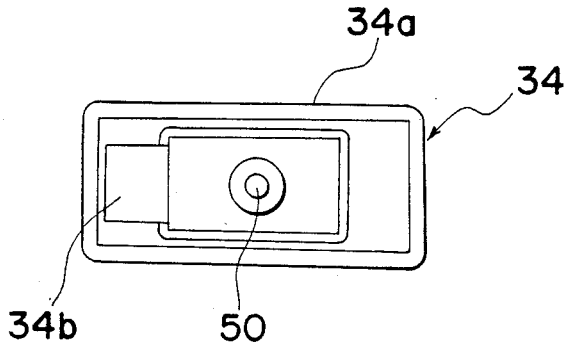
FIG. 3 is a top plan view of a rubber hood used in the switch assembly shown in FIG. 1.
Figure 4:
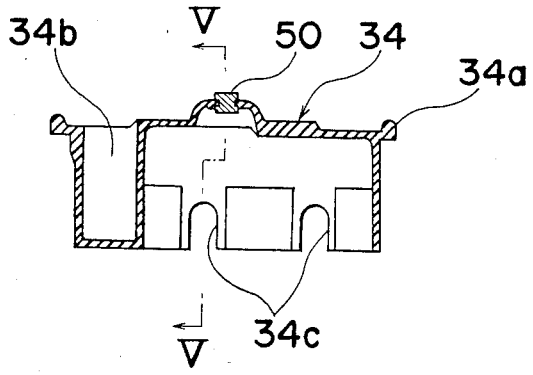
FIG. 4 is a longitudinal sectional view of the rubber hood.
Figure 5:
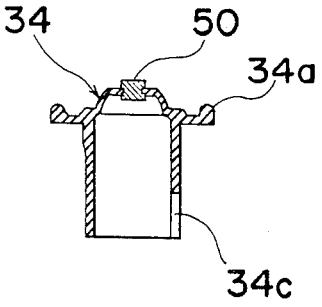
FIG. 5 is a cross-sectional view of the rubber hood taken along the line V—V in FIG. 4.
Figure 6:
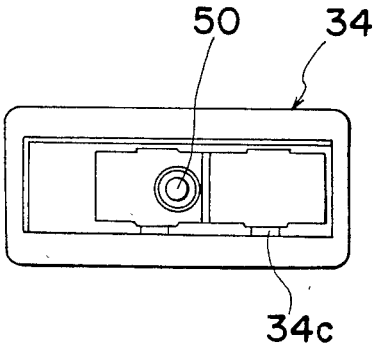
FIG. 6 is a bottom plan view of the rubber hood.
Figure 7:
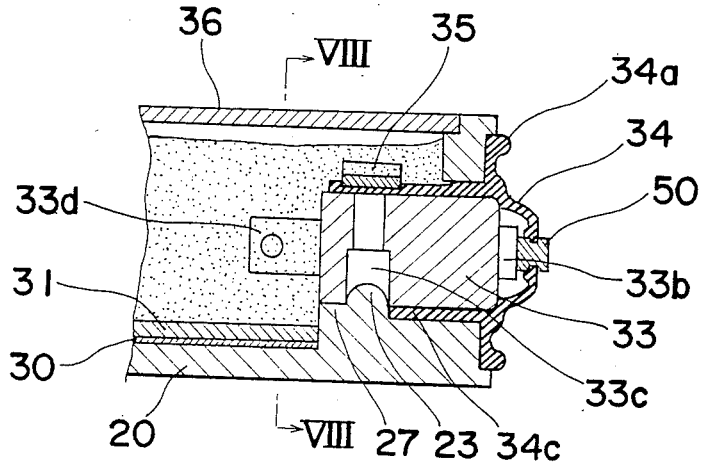
FIG. 7 is a cross-sectional view taken along the line VII—VII in FIG. 1.

Referring first to FIGS. 1 and 2, a limit switch assembly embodying the present invention generally comprises a head 1 and a switch box 20 both connected together by means of a plurality of, for example, two, connecting bolts or screws 10.

The head 1 has a tubular bearing member 2 protruding outwards from one surface thereof opposite the switch box 10. A plunger 3, forming a part of an actuator for a built-in switch 33 as will be described later, extends through the bearing member 2 for axial movement between projected and depressed positions, with an O-ring 4 interposed between the plunger 3 and the bearing member 2 so as to avoid any possible intrusion of foreign matters into the interior of the head 1. The plunger 3 is shown as having a roller member 5 rotatably mounted on an outer end thereof positioned exteriorly of the head 1 for engagement with an external driving element (not shown). The plunger 3 so supported by the bearing member 2 is normally biased to the projected position, as shown in FIG. 1, by a return spring 7 interposed between the plunger 3 and a generally rectangular spring seat member 6 secured to one surface of the head 1 opposite to the surface thereof from which the bearing member 2 projects outwardly and confronting the switch box 20. Axially slidably inserted within the plunger 3 is a generally elongated operating piece 8 which is normally biased in a direction counter to the plunger 3 by a safety spring 9 substantially housed within the plunger 3 and interposed between the plunger 3 and one end of the operating piece 8, the other end of said operating piece 8 protruding outwardly through an opening *6a* in the spring seat member 6.

In the construction so far described, it will be readily seen that, when the plunger 3 is moved towards the depressed position against the return spring 7 by the application of an external driving force thereto through the roller 5, the safety spring 9 tending to be axially inwardly compressed urges the operating piece 8 to move in the same direction as the plunger 3 is moved, with the other end of said operating piece 8 consequently protruding a required distance outwardly from the opening *6a* in the spring seat member 6.

Figure 8:
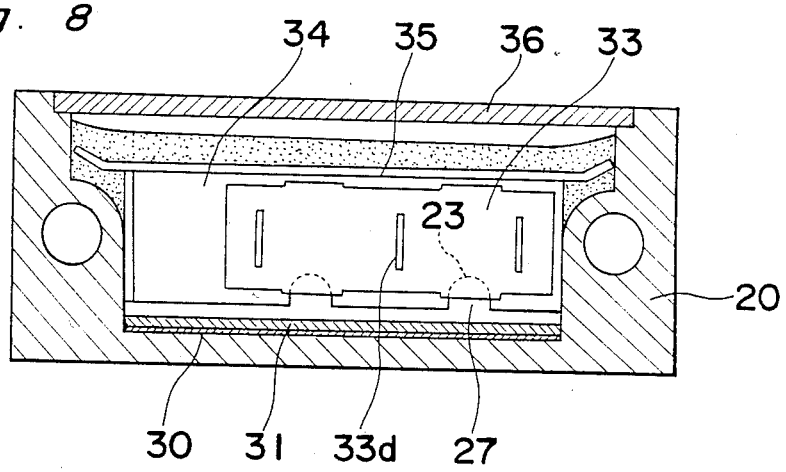
FIG. 8 is a cross-sectional view taken along the line VIII—VIII in FIG. 7.
Figure 9:
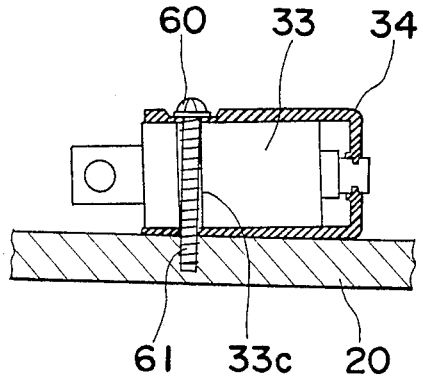
Fig. 9 PRIOR ART
FIG. 9 is a schematic sectional view illustrating the manner in which a built-in switch is secured in position by set screws.

The switch box 20 is a generally box-like container having a recess 21 defined therein leaving four continued side walls and a bottom wall as viewed in FIG. 2. Within the recess 21, there is disposed a sheet-like insulator 30 and a printed circuit board 31 both held against the bottoms wall of the switch box 20. The built-in switch 33 is also accommodated within the recess 21 and positioned on one side of the printed circuit board 31 opposite to the insulator 30, but in the form as covered by a rubber hood 34. The rubber hood 34, shown in detail in FIGS. 3 to 6, is of generally box-like configuration and is of such a design as to substantially cover all of the surfaces of the built-in switch 33 except for the surface thereof from which terminal members *34d* protrude outwardly for external electrical connection. It is to be noted that the surfaces of the built-in switch 33 covered by the rubber hood 34 include the surface *33a* from which a push-button *33b* extends outwardly and the opposite surfaces at which the opposite ends of each of the mounting holes *33c* defined in the built-in switch are opened. The rubber hood 34 has a circumferential flange *34a* protruding laterally outwardly therefrom in a plane generally in flush with the surface *33a* of the built-in switch 33, which circumferential flange *34a* is adapted to be clamped between the head 1 and the switch box 20. A portion of the rubber hood 34 confronting the surface *33b* of the built-in switch 33 has a metal piece 50 inserted in alignment with the push button *33b* on the one hand and with the operating piece 8 on the other hand. The rubber hood 34 has a cavity *34b* defined therein at a location laterally of the built-in switch 33, which cavity *34b* is in communication with the interior of the head 1 to substantially increase the volume of the interior of the head 1 for the purpose as will be described later. The rubber hood 34 also has cutouts *34c* formed therein at a portion thereof confronting the bottom of the recess 21 and generally in alignment with the respective openings of the mounting holes *33c*, such that when and after the switch 33 having been covered by the rubber hood 34 has been inserted into the recess 21 of the switch box 20 through an opening 22 in said box 20 in a manner with the push button *33b* located outside the switch box 20, spaced projections 23 integral with the bottom wall of the switch box 20 tightly fit into the associated holes *33c* in the built-in switch 33 through the respective cutouts *34c* to hold the switch 33 in position within the switch box 20. The switch 33 so accommodated in the switch box 20 is secured in position by a generally elongated stopper 35 press-fitted into the box 20 with its opposite ends tightly engaged against the opposite side walls of the box 20 as best shown in FIG. 8. In this condition, steps 27 formed laterally of the respective projections 23 contact the lateral surface of the switch 33 through the associated cutouts *34c* in the rubber hood 34 as best shown in FIG. 8, and, therefore, the extent to which the switch 33 is urged by the stopper 35 against the bottom wall of the box 20 can advantageously restricted by the contact between the steps 27 and the lateral surface of the switch 33. After the switch 33 has been mounted and fixed in position within the box 20, the opening of the box 20 leading into the recess 21 is closed by a name plate 36 secured in position by staking projections 24 integral with the box 20 after they have passed through the name plate 36.

The side wall of the box 20 confronting the opening 22 is formed with a bore 25 into which a rubber bushing 37 having a cord 38 extending therethrough is sealingly plugged. The cord 38 has a plurality of insulated lead wires *38a*, one connected to a grounding pin 39 inserted in the switch box 20 and the remaining lead wires connected respectively to the terminal members *33d*. The switch box 20 is also formed with a window 26 at a corner area defined by the side wall with the bore 25 and the adjoining side wall, which window 26 is covered by a transparent lens member 40 so that a display element 32, such as a light emitting diode or the like, mounted on the printed circuit board 31 can be viewed from the outside of the switch box 20.

The switch assembly of the construction described above can be fabricated in the following manner. The insulator 30 and the printed circuit board 31 are placed within the switch box 20 and, thereafter, the switch 33 covered with the rubber hood 34 is inserted into the box 20 through the opening 22. The stopper 35 is then inserted into the box 20 with its opposite ends sliding along the associated side walls of the box 20 to fix the switch 33 firmly in position within the box 20. At this time, a portion of the opening 22 around the switch 33 and exterior of the rubber hood 34 is closed by the circumferential flange *34a* integral with the rubber hood 34, which circumferential flange *34a* is then positioned exteriorly of the box 20 surrounding the opening 22 in the box 20.

Thereafter, the cord 38 having the rubber bushing 37 thereon is inserted through the bore 25 so as to extend into the interior of the box 20 with the rubber bushing 37 tightly plugged into the bore 25. After the lead wires 38*a* bundled in the cord 38 have been connected to the grounding pin 39 and the terminal members 33*d* of the switch 33, a synthetic filler material such as, for example, an epoxy resin, is poured into the recess 21 to solidify therein and the name plate 36 is then placed to close the opening of the box 20 leading into the recess 21. In this assembled condition so far described, even though foreign matters such as dusts and oil fall on the box 20, they do not reach the switch 33 and, thus, the switch 33 is protected from them.

When the head 1 having the actuator for the switch 33 incorporated therein is mounted on the switch box 20 with the operating piece 8 aligned with the push button 33*b*, and fastened thereto by means of the connecting screws 10, the circumferential flange 34*a* of the rubber hood 34 is tightly clamped between the head 1 and the box 20 to seal the joint therebetween, thereby completing the fabrication of the switch assembly according to the present invention.

It is to be noted that, since the rubber hood 34 is positioned within the box 20 together with the switch 33 in the manner as hereinbefore described, the circumferential flange 34*a* would neither deform nor displace and is uniformly clamped between the head 1 and the box 20 and, therefore, the joint therebetween can be sealed tightly.

The switch assembly according to the present invention described with reference to and shown in FIGS. 1 to 8 operates in a manner similar to a conventional limit switch assembly. That is to say, when the roller 5 contacts the external driving element, the plunger 3 is moved from the projected position towards the depressed position against the return spring 7, accompanied by the corresponding movement of the operating piece 8. As the operating piece 8 moves as urged by the safety spring 9, the end of the operating piece 8 adjacent the metal piece 50 protrudes the required distance outwardly from the opening 6*a* in the spring seat member 6 to depress the push button 33*b* through the metal piece 50. When the push button 33*b* is depressed, the switching state of the switch 33 changes and the display element 32 may be energized or deenergized to provide through the transparent lens element 40 a visual indication of a particular switching state of the switch 33.

It is, however, to be noted that, as the plunger 3 moves from the projected position towards the depressed position, air within the head 1 is compressed and, in such case, the relatively large driving force would be required to move the plunger 3 towards the depressed position. According to the present invention, this problem is eliminated by the provision of the cavity 34*b* which in essence increases the volume of the space that is compressed by the movement of the plunger 3, and therefore, no substantially increased driving force is required to move the plunger 3 towards the depressed position.

It is also to be noted that, when the plunger 3 is maintained in the depressed position for a substantially long time, the compressed air within the head 1 may leak to such an extent that the pressure within the head 1 becomes equal to the atmospheric pressure. In the event that the driving force applied to the plunger 3 to maintain the latter in the depressed position is released when and after the pressure inside the head 1 has become equal to the atmospheric pressure, the return movement of the plunger 3 back to the projected position by the action of the spring 7 may develop a negative pressure inside the head 1, imposing a resistance to the smooth movement of the plunger towards the projected position. This problem is also eliminated according to the present invention by the provision of the cavity 34*b* which, in this case, acts to minimize the development of the negative pressure.

It is further noted that, even when the filler material of a type which solidifies upon cooling is poured into the switch box 20, it will not penetrate into between the rubber hood 34 and the switch 33 and then towards the push button 33*b* because the rubber hood 34 contacts the peripheral surface of the switch 33 by the action of its own elasticity thereby avoiding the penetration of the poured filler material.

From the foregoing full description of the present invention, it has now become clear that, since the switch is covered by the rubber hood, the switch is protected not only from the external foreign matter, but also from impact Therefore, the switch assembly as a whole has a dust-proof structure with an improved resistance to impacts. In addition, since no screw elements are employed to secure the switch in position, the switch assembly as a whole is relatively easy to fabricate with no possibility of the switch being displaced relative to the operating piece.

Furthermore, the presence of the cavity in the rubber hood is advantageous in that the smooth movement of the plunger is assured at all times without being affected by the pressure which may be developed within the head.

Although the present invention has fully been described in connection with the preferred embodiment thereof with reference to the accompanying drawings, it is to be noted that various changes and modifications are apparent to those skilled in the art. By way of example, although the actuator for the switch has been described and shown as comprised of the plunger and the operating piece, it may comprise a lever or any other actuator operable to push the push button of the switch exteriorly of the rubber hood.

In addition, the use of the filler material although it is advantageous in that the internal parts can be protected and insulated, is not always essential to the present invention and may, therefore, be omitted.

Furthermore, although the switch has been described as inserted into the box through the opening defined in the box so as to confront the head, it may be loaded into the box through the opening which is subsequently closed by the name plate. In this case, the rubber hood may have holes in place of the cutouts 34*c*.

Accordingly, the changes and modifications are to be understood as included within the true scope of the present invention as defined by the appended claims, unless they depart therefrom.

What is claimed is:

1. A limit switch assembly which comprises:

a head having an actuator movable between a first and a second operative position;

a switch having a push button protruding outwards from a first area thereof and movable between projected and depressed positions corresponding respectively to the first and second operative positions of the actuator, said switch also having at least two terminal members protruding outwards from a second area thereof for the electrical connection with external wiring elements, said switch further having at least one mounting hole defined therein;

a rubber hood configured to substantially tightly receive the switch therein except for the second area of the switch, said rubber hood having a circumferential flange formed integrally therewith so as to extend outwards therefrom in a plan generally parallel to the first area of the switch;

a switch box having an opening defined therein at a location confronting the head, and accommodating therein the switch together with the rubber hood, said circumferential flange being, when the switch is so accommodated in the switch box, positioned exteriorly of the switch box and surrounding the opening in the switch box, said switch box further having a projection formed therein for engagement into the mounting hole when the switch is accommodated in the switch box and wherein a portion of said rubber hood corresponding in position to the mounting hole is removed to provide a cutout clearing the projection;

means for connecting the head and the switch box together with the actuator aligned with the push button through a portion of the rubber hood covering said push button, said circumferential flange being, when the head and the switich box are connected together, tightly clamped therebetween; and stopper means for pressing the switch against a wall of the switch box to secure said switch in position within the switch box.

2. An assembly as claimed in claim 1, wherein the switch box has a step defined therein at a location laterally of the projection, said step contacting the switch through the cutout in the rubber hood.

3. An assembly as claimed in claim 1, wherein said rubber hood has a cavity defined therein in communication with the interior of the head.

* * * * *